US006374461B1

(12) United States Patent
Gober et al.

(10) Patent No.: US 6,374,461 B1
(45) Date of Patent: Apr. 23, 2002

(54) FLEXIBLE HINGED HANDLE AND CARRYING BAG EMPLOYING THE SAME

(75) Inventors: David A. Gober, Hermann, MO (US); Doug Turner, Spartanburg, SC (US)

(73) Assignee: Exopack, LLC, Spartanburg, SC (US)

( * ) Notice: Subject to any disclaimer, the term of this patent is extended or adjusted under 35 U.S.C. 154(b) by 0 days.

(21) Appl. No.: 09/522,698

(22) Filed: Mar. 10, 2000

(51) Int. Cl.[7] ..... B65D 33/06

(52) U.S. Cl. ..... 16/444; 16/445; 16/114.1; 383/13; 383/17

(58) Field of Search ..... 16/444, 445, 114.1, 16/406, 408, 409, 410, 411; 383/13, 14, 17, 24

(56) References Cited

U.S. PATENT DOCUMENTS

| | | | | | |
|---|---|---|---|---|---|
| 1,374,251 | A | * | 4/1921 | Thompson | 16/408 |
| 1,418,095 | A | * | 5/1922 | Ringer | 16/410 |
| 2,050,967 | A | | 8/1936 | Farmer | |
| 2,182,261 | A | | 12/1939 | Maas | |
| 2,434,630 | A | * | 1/1948 | Rosen | 16/444 |
| 2,625,318 | A | | 1/1953 | Ross | |
| 3,207,397 | A | * | 9/1965 | Wilson | 383/13 |
| 3,251,390 | A | | 5/1966 | Evans | |
| 3,452,922 | A | | 7/1969 | Hart | |
| 3,463,381 | A | * | 8/1969 | Wainberg | 383/17 |
| 3,498,244 | A | | 3/1970 | Blanchette | |
| 3,549,085 | A | | 12/1970 | Hart | |
| 3,722,377 | A | | 3/1973 | Hayes | |
| 4,040,562 | A | * | 8/1977 | Ward et al. | 229/54 R |
| D255,332 | S | | 6/1980 | DuCorday | |
| 4,205,748 | A | | 6/1980 | Wilson | |
| 4,387,846 | A | * | 6/1983 | Ducorday | 229/54 R |
| 4,610,349 | A | | 9/1986 | Schwartz | |
| 4,854,732 | A | * | 8/1989 | Italici | 383/6 |
| 4,902,060 | A | * | 2/1990 | Nobakht | 294/171 |
| 4,902,140 | A | | 2/1990 | Branson | |
| 5,029,926 | A | * | 7/1991 | Dieterich et al. | 294/171 |
| 5,059,033 | A | | 10/1991 | Branson | |
| 5,145,258 | A | * | 9/1992 | Schneck et al. | 383/14 |
| 5,290,104 | A | | 3/1994 | Sengewald | |
| 5,328,266 | A | | 7/1994 | Davis | |
| 5,346,708 | A | | 9/1994 | Carson | |
| 5,356,221 | A | | 10/1994 | Achelpohl et al. | |
| 5,480,091 | A | | 1/1996 | Stout | |
| 5,836,695 | A | | 11/1998 | Hanson | |

FOREIGN PATENT DOCUMENTS

| | | |
|---|---|---|
| CA | 542114 | 6/1957 |
| CA | 590802 | 1/1960 |
| FR | 1152509 | 6/1956 |
| FR | 1175934 | 11/1957 |
| FR | 1279773 | 1/1961 |
| FR | 2306892 | 11/1975 |
| GB | 230188 | 3/1925 |
| GB | 1315891 | 2/1973 |
| GB | 2146615 | 4/1985 |

* cited by examiner

*Primary Examiner*—Anthony Knight
*Assistant Examiner*—Mark Williams
(74) *Attorney, Agent, or Firm*—Watov & Kipnes, P.C.

(57) ABSTRACT

A thin flexible handle for carrying a bag in which the gripping portion of the handle is separated from respective legs by a gap having a surface having a radius of curvature sufficient to provide the handle with resistance to tearing.

19 Claims, 4 Drawing Sheets

FLEXIBLE HINGED HANDLE AND CARRYING BAG EMPLOYING THE SAME

FIELD OF THE INVENTION

The present invention is generally directed to a flexible handle for carrying a bag, particularly multi-ply bags for carrying bulk commodities such as rice, seed, fertilizer and the like in which the handle is soft and easy to grip.

BACKGROUND OF THE INVENTION

Multi-ply and single ply, kraft and plastic bags are used in the packaging industry to package bulk commodities such as rice, seed, salt, animal foods, charcoal briquets, agricultural chemicals and the like. The bags have a generally rectangular shape with an optional gusset, typically of from about 3 to 6 inches in width. The packaging volume of such bags is sufficient to carry loads of the bulk commodities on the order of 10 to 25 pounds and at times the weight of the commodity can be up to 50 pounds. In some cases the bags are provided with a handle to facilitate carrying.

One end of such bags has a handle attached thereto by stitching, gluing, heat sealing and the like. The other end of the bag remains open until the bag commodity is loaded. When loading is completed, the open end is closed by sealing or the like. In the manufacture of such bags, it is desirable to provide a flexible handle that is no thicker than the bag in its folded condition. In this way, the bag and the handle can be stacked flat within a carton and shipped to the bulk commodity supplier.

An example of a handle for this purpose is shown in Schneck, U.S. Pat. No. 5,145,258. The handle has a desirably thin, flat construction so that the thickness of the handle is no greater than the width of the bag when it is folded and stacked for shipping. The handle must also be pivotable about its end so that when the gripping portion of the handle is engaged by the user, the handle will pivot upwardly as shown specifically in FIG. 1 of U.S. Pat. No. 5,145,258.

While it is desirable to construct the flexible handle of a bag with a flat, thin profile, it is also highly desirable to provide a handle which fits comfortably in the finger region of the hand even under heavy loads. Current designs including the handle shown and described in the '258 Patent are disadvantageous because they dig into the fingers and/or are uncomfortable because the weight of a fully loaded bag provides excessive stress on the gripping portion of the handle. In particular, when the handle is engaged by the user and the bag lifted, substantially the entire weight of the bag is directed downwardly against the user's fingers through the gripping portion. The width and shape of the gripping portion is therefore critical in distributing the weight of the load. Current designs which employ thin and/or concave shape gripping portions are prone to stress because of their relatively low surface area. For example, typical handle designs currently in use are uncomfortable even when the load is no more than about 20 pounds per square inch.

In addition to the stress placed on the user's hand, the thin handles of the type used in industry often cannot withstand the physical stress resulting from the load. As a result such handles often tear. One of the critical aspects in designing a soft flexible handle, in addition to a user friendly gripping portion and a thin, flexible construction, is that the handle must be resistant to tearing even when under heavy loads. Tearing is often caused by a weakness in the handle design such that the applied load exceeds what the handle can support at a particular location along the surface of the handle design. With handle designs such as disclosed in the U.S. Pat. No. 5,148,258 tearing often occurs at the junction between the gripping portion and the leg portions of the handle.

It would therefore be a significant advance in the art of providing handles for multi-ply and single ply bags for packaging a variety of products including commodities if a handle could be produced which is thin, soft and flexible, yet strong enough to withstand tearing even when supporting loads of up to 25 to 50 pounds.

It would be a further advance in the art if a thin soft and flexible durable handle could be provided which is simple to manufacture and inexpensive to produce.

SUMMARY OF THE INVENTION

The present invention is generally directed to a thin flexible handle for a carrying bag which is thin enough to be stored with the bag in a folded condition and not add to the depth of the stored bag, and is soft and flexible so that it can be readily gripped by the user. The handle should have a soft comfortable feel even when supporting loads of up to 50 pounds. The present handle also desirably has a construction which resists tearing even under such significant loads.

In a particular aspect of the present invention, there is provided a thin flexible handle for a carrying bag comprising:

a) a pair of legs each having a first end for attachment to the bag and a remote end, said handle being pivotable about said first end when the bag is lifted;

b) a pair of connecting portions operatively connected to the respective legs at said remote ends and defining a gripping portion therebetween; and c) a gripping portion for engagement by the user to lift the bag, said gripping portion being separated from the respective legs by a gap having a surface contiguous with the connecting portion, said surface having a radius of curvature sufficient to provide the handle with a resistance to tearing.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The handle of the present invention may be attached to a variety of carrying bags but is particularly adapted for use in conjunction with gusseted multiply and single ply bags for carrying bulk commodities such as seed, rice, salt, pet foods, agricultural chemicals, charcoal briquets and the like.

The handle is provided with features that make it soft and flexible, thin and tear resistant even under relatively heavy loads.

Figure 1:
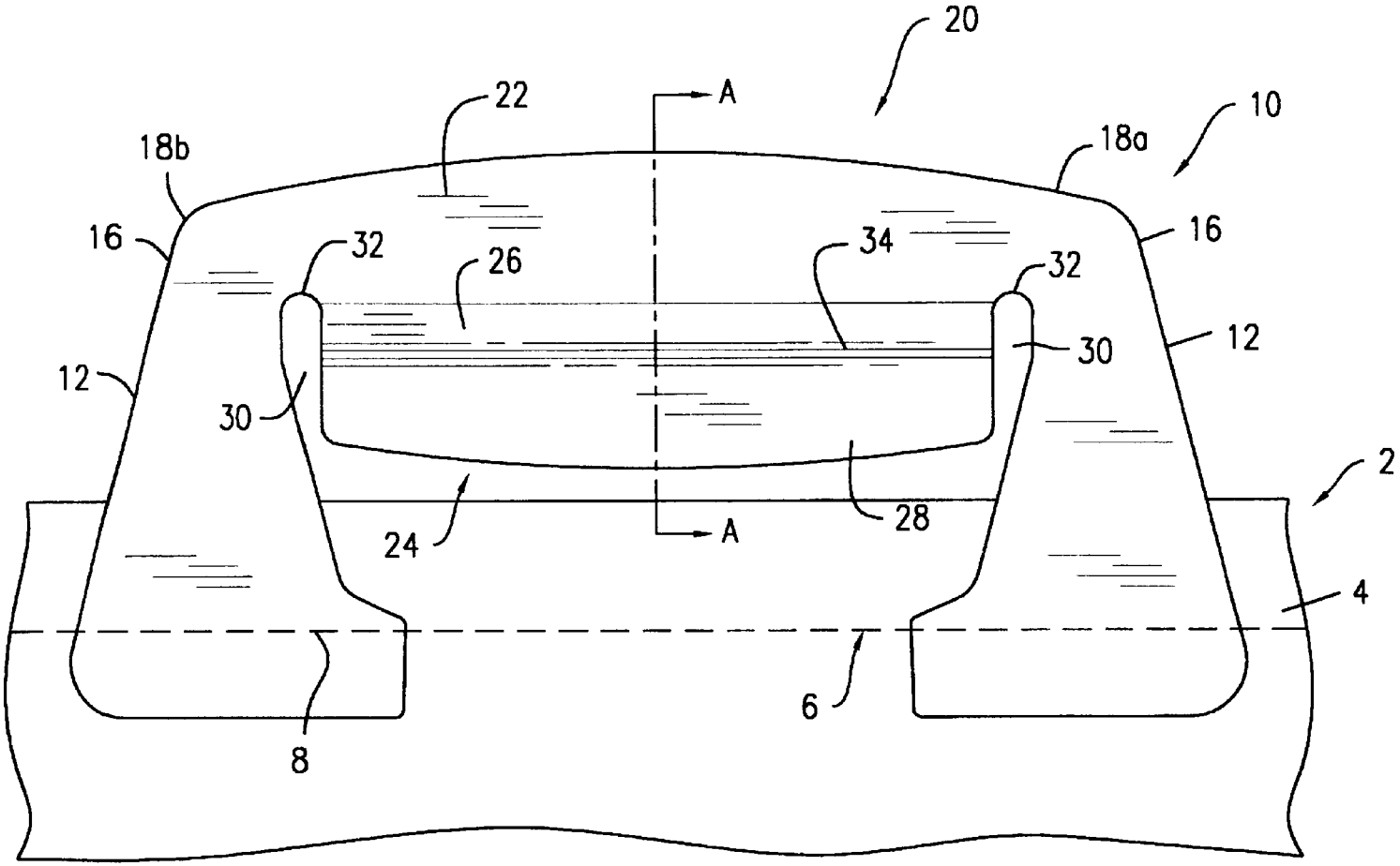
FIG. 1 is a front view of an embodiment of a handle of the present invention.
Figure 2:
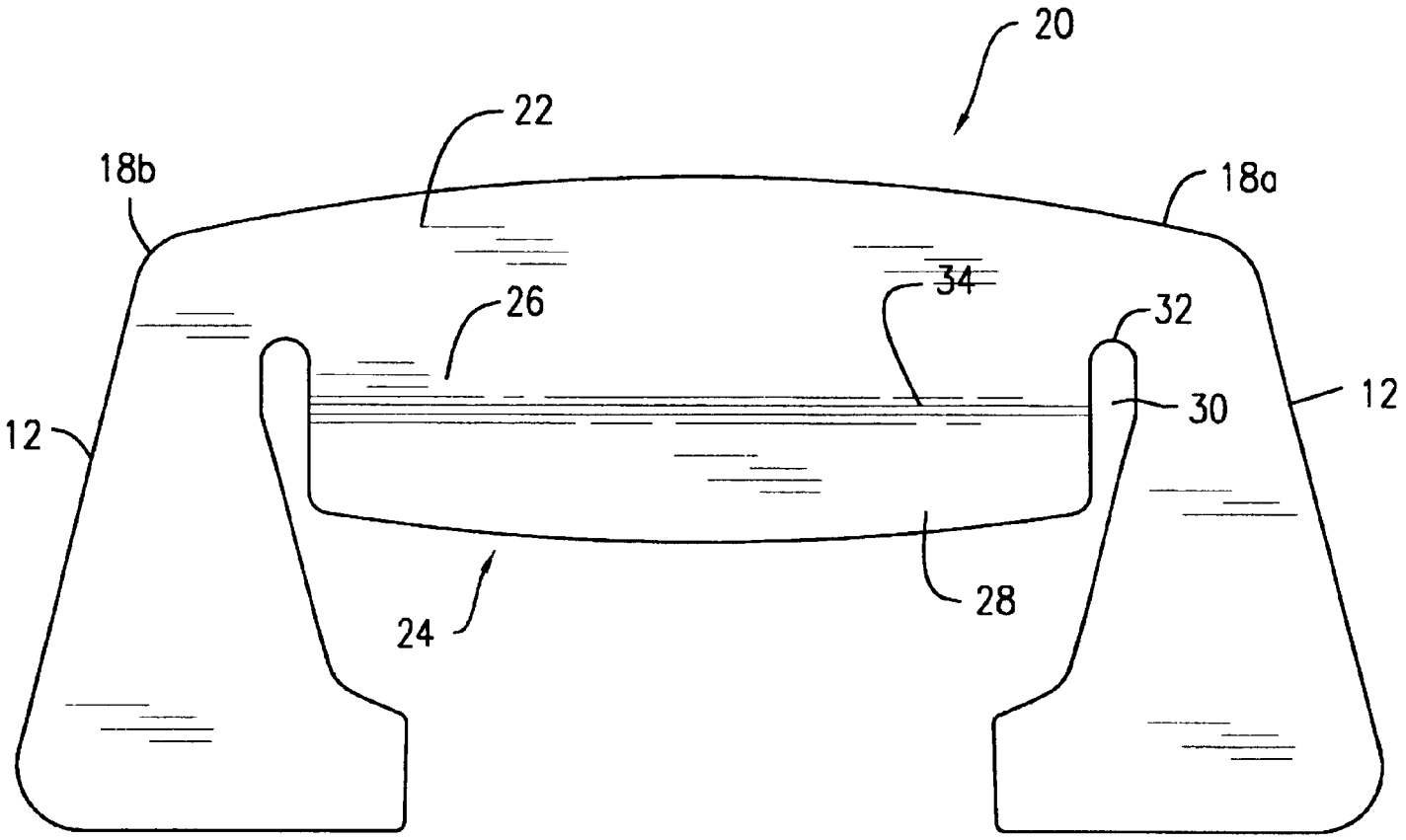
FIG. 2 is a rear view of the handle of the present invention shown in FIG. 1.
Figure 3:
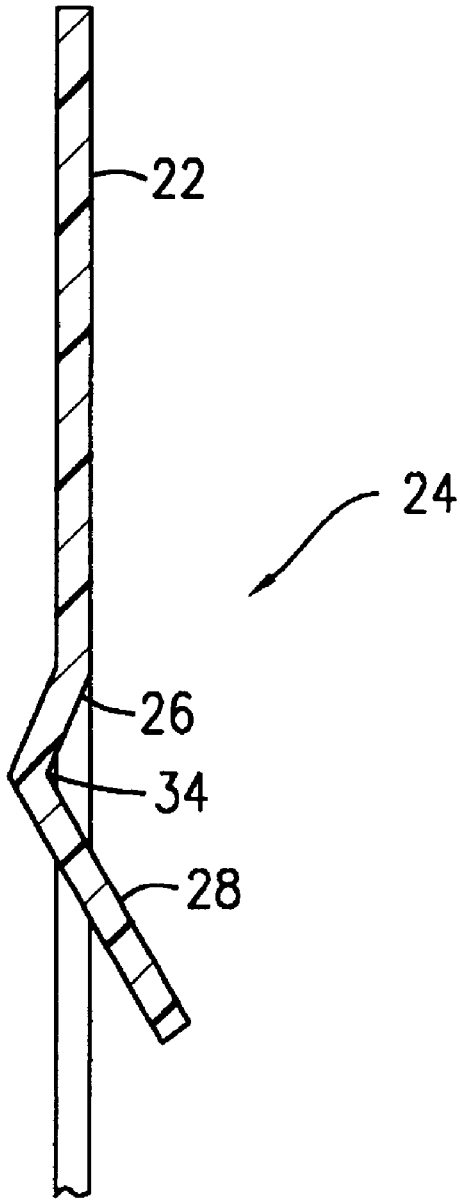
FIG. 3 is a cross-sectional view taken through line A—A of FIG. 1.

Referring to the drawings and particularly FIGS. 1 and 2, there is provided an embodiment of a handle which may be attached to the side of a bag in a conventional manner known to those of ordinary skill in the art. In particular, a carrying bag identified by the numeral 2 has an end 4 which is sealed and an opposed end (not shown) which remains open for the loading of a bulk commodity. The end 4 is provided with a conventional closure strip including a tear strip identified by the numeral 6 known to those in the packaging art made of cloth, paper and the like. The closure strip is typically a folded over, paper strip that is secured by adhesive and/or sewn to the bag 2. The closure strip is secured to the bag 2 by heavy duty stitching 8 which is sewn across the end 4 of the bag. In this way, the end 4 of the bag 2 is sealed so that the commodity may be loaded into the other end of the bag. When the closure strip is stripped away to open the bag, the handle remains attached to the bag without tearing from it.

The handle 10 of the present invention is secured to the bag 2 through the stitching 8 so that the handle 10 lies flat against the bag and may be readily packaged and stored prior to loading. As described in detail hereinafter, the composition of the handle and certain design features enable the handle to provide a thin and flat profile which does not add to the depth of the bag when the bag is stored or shipped, yet provides significant resistance to tearing even at loads of up to about 50 pounds.

The handle 10 includes a pair of legs 12 which are stitched to the bag concurrently with the closure strip 6 as described above. The legs 12 include remote ends 16 which are attached to, preferably integral with respective connecting portions 18*a* and 18*b*. Lying between the connecting portions 18*a* and 18*b* is a gripping portion shown generally by the numeral 20. In accordance with a preferred form of the invention, the connection portions 18*a* and 18*b* are integral with the gripping portion 20 and the handle 10 is made by injection molding. The gripping portion 20 is comprised of an upper section 22 and a lower section 24. The upper section 22 is located between the respective connecting portions 18*a* and 18*b* and is preferably integral therewith.

The lower section 24 is comprised of a proximal portion 26 and a distal portion 28. In accordance with one aspect of the present invention, there is a junction between the proximal portion 26 and the distal portion 28 having a radius of curvature as hereinafter discussed which enables a gripping portion to better conform to the grip of the user, especially when the bag 2 is being lifted under a heavy load.

In another aspect of the present invention, the lower section 24 of the gripping portion 20 is spaced apart from the respective legs 12 by a gap 30. The gap 30 enables the lower section 24 of the gripping portion 20 to move upwardly and conform to the shape of the user's fingers or palm.

The gap 30 has a surface 32 which is susceptible to tearing when the lower section 24 is gripped by the user. The surface 32 bears significant stress when the handle is engaged by the user causing the lower section to move upwardly and conform to the shape of the user's palm.

In accordance with a further aspect of the present invention, the surface 32 is made curvilinear with a radius of curvature as hereinafter defined which Applicants have determined distributes the weight bearing load in a manner which resists tearing. The radius of curvature is defined as an arc formed from a given radius.

In accordance with a preferred aspect of the present invention, the radius of curvature of the surface 32 is typically in the range of 0.092 to 0.138 inch, most preferably from about 0.110 to 0.124 inch. By providing the surface 32 with a radius of curvature as defined above, Applicants have determined that there is significant resistance to tearing because the weight bearing surface has the weight of the bag more uniformly distributed.

As previously indicated, the lower section 24 of the gripping portion 20 is divided into a proximal portion 26 and a distal portion 28. A junction 34 is provided therebetween. The width of the distal portion is typically from about 0.350 to 0.850 inch. The preferred width of the distal portion is from about 0.450 to 0.650 inch. The typical width of the proximal portion 26 is from about 0.190 to 0.350 inch, preferably from about 0.225 to 0.275 inch.

The junction 34 in accordance with the present invention has a radius of curvature of from about 0.25 to 0.50 inch, preferably from about 0.35 to 0.40 inch.

As previously indicated, the thickness of the handle should be limited so that it does not add any thickness to the carrying bag 2 when it is folded lying flat in a stored condition for shipping. In this regard, the handle typical has a thickness of from about 0.045 to 0.090 inch, preferably from about 0.055 to 0.065 inch.

The handle 10 of the present invention is preferably made of a soft flexible material that is strong enough to withstand the stress placed upon the handle by fully loaded carrying bags. In a preferred form of the invention, the handle is made of a plastic composition comprising a relatively stiff plastic material and a relatively soft plastic material. Alternatively, the handle may be of a medium density material such as medium density polyethylene. The preferred stiff plastic materials include high density polyethylene, polypropylene and nylon. The preferred soft plastic materials are selected from low density polyethylene and ethylene vinyl acetate copolymers. The combination of high density polyethylene and low density polyethylene provides a particularly advantageous plastic composition for use in the present invention. The amount of the high density polyethylene is typically in the range of about 20% by weight and the amount of the low density polyethylene is likewise at least 20% by weight. A preferred composition provides about 50% by weight of high density polyethylene and about 50% by weight of low density polyethylene. It will be understood that mixtures of high, low and/or medium density plastic materials may be employed.

Figure 4:
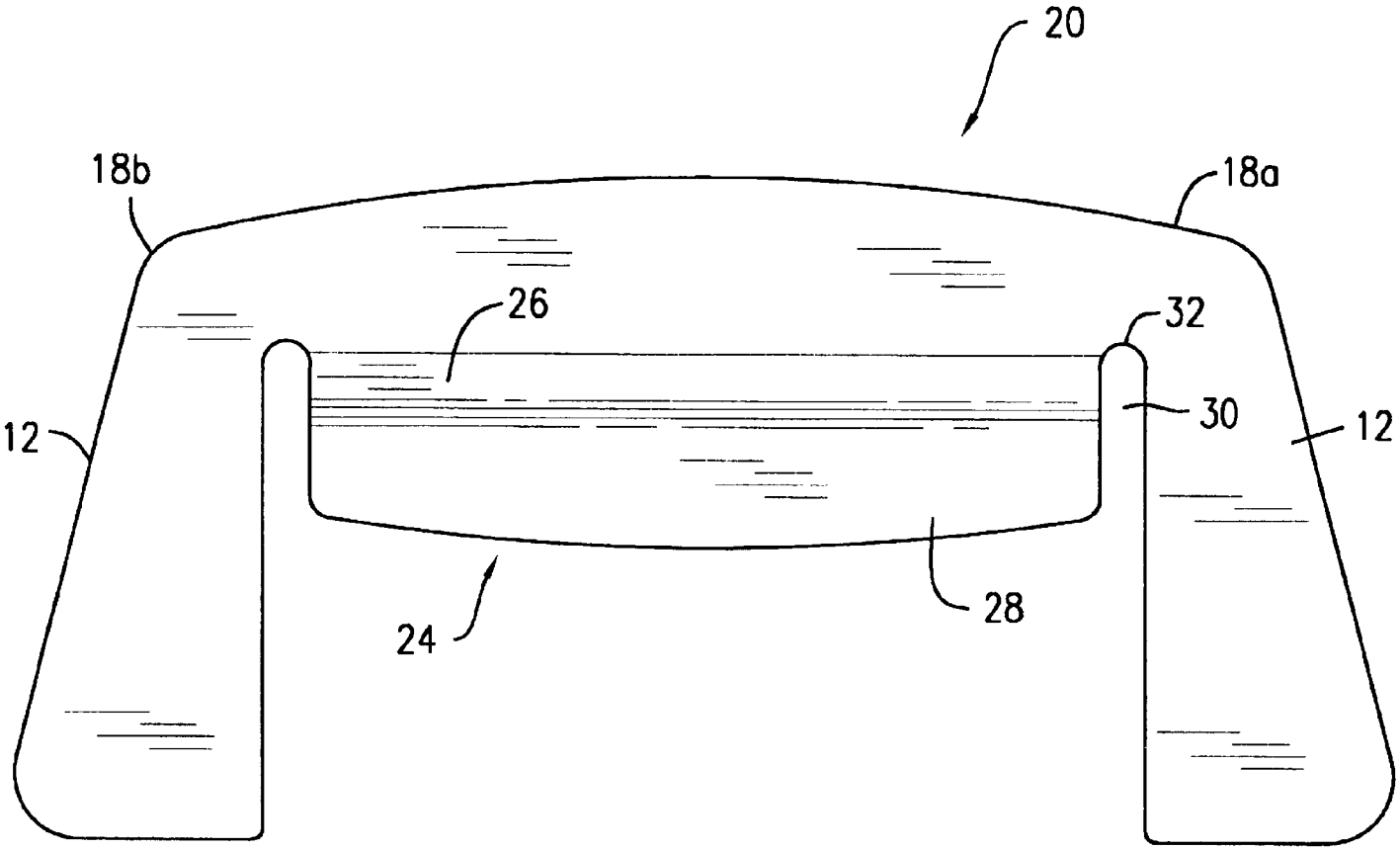
FIG. 4 is a front view of another embodiment of a handle of the present invention.

In the embodiments shown in FIGS. 1 and 2, the legs 12 of the handle 10 have a lower portion providing a relatively large surface area. This extended leg version of the handle is advantageous because it provides a larger surface area through which the stitching 8 may secure the handle to the bag 2. It will be understood as shown in FIG. 4 that the legs 12 need not be provided with an extended lower portion. In this embodiment of the invention, some savings in production can be achieved by reducing the amount of plastic necessary to form the handle and particularly in the leg region. It will be understood that this embodiment may be applicable to use with carrying bags that contain lower weight products such as in the range of from about 10 to 25 pounds.

In operation, when the bag is lifted by gripping the handle, the handle pivots about the base of the legs which remain attached to the bag by stitching or the like. The gripping portion, under load from the bag, conforms to the user's finger's or palm because of the pivotal motion provided at the junction between the proximal and distal portions.

It will be understood that other embodiments of the invention would be apparent to those of ordinary skill in the art and are included within the spirit and scope of the present invention.

What is claimed is:

1. A thin flexible handle for a carrying bag comprising:

a) a pair of legs each having a first end for attachment to the bag and a remote end, said handle being pivotable about said first end when the bag is lifted;

b) a pair of connecting portions operatively connected to the respective legs at said remote ends and defining a gripping portion therebetween; and c) a gripping portion for engagement by the user to lift the bag, said gripping portion being separated from the respective legs by a gap having a surface contiguous with the connecting portion, said surface having a radius of curvature of at least 0.092 inch sufficient to provide the handle with a resistance to tearing.

2. The flexible handles of claim 1 wherein the radius of curvature of said surface is from about 0.092 to 0.138 inch.

3. The flexible handle of claim 2 wherein the radius of curvature is from about 0.110 to 0.124 inch.

4. The flexible handle of claim 1 wherein the thickness of the handle is from about 0.045 to 0.090 inch.

5. The flexible handle of claim 4 wherein the thickness of the handle is from about 0.55 to 0.65 inch.

6. The flexible handle of claim 1 wherein the gripping portion comprises a proximal portion operatively connected to the connecting portions and a distal portion extending at an acute angle from the proximal portion.

7. The flexible handle of claim 6 wherein the proximal and distal portions are separated by a junction having a radius of curvature of from about 0.25 inch to 0.50 inch diameter.

8. The flexible handle of claim 7 wherein the radius of curvature of the junction is from about 0.35 to 0.40 inch.

9. The flexible handle of claim 6 wherein the distal portion has a width of from about 0.350 to 0.850 inch.

10. The flexible handle of claim 9 wherein the width of the distal portion is from about 0.450 to 0.650 inch.

11. The flexible handle of claim 6 wherein the proximal portion has a width of from about 0.190 to 0.350 inch.

12. The flexible handle of claim 11 wherein the proximal portion has a width of from about 0.225 to 0.275 inch.

13. The flexible handle of claim 1 made of composition comprising a relatively stiff plastic material and a relatively soft plastic material.

14. The flexible handle of claim 13 wherein the relatively stiff plastic material is selected from the group consisting of high density polyethylene, polypropylene, and nylon.

15. The flexible handle of claim 13 wherein the relatively soft plastic material is selected from the group consisting of low density polyethylene, and ethylene vinyl acetate copolymers.

16. The flexible handle of claim 13 wherein the composition comprises at least 20% by weight high density polyethylene and at least 20% by weight low density polyethylene.

17. The flexible handle of claim 13 wherein the composition comprises about 50% by weight of high density polyethylene and about 50% by weight of low density polyethylene.

18. The flexible handle of claim 1 made of a composition comprising a medium density plastic material.

19. The flexible handle of claim 1 wherein the medium density plastic material is medium density polyethylene.

* * * * *